US009932186B2

(12) United States Patent
Erdem et al.

(10) Patent No.: US 9,932,186 B2
(45) Date of Patent: Apr. 3, 2018

(54) APPARATUS AND METHOD FOR WINDING AND UNWINDING WEB MATERIAL

(71) Applicant: The Procter & Gamble Company, Cincinnati, OH (US)

(72) Inventors: Gueltekin Erdem, Schwalbach am Tanus (DE); Walter Pieter Hendrik Laurentius van der Klugt, Mechernich Satzvey (DE); Sudhanshu Gupta, Euskirchen (DE)

(73) Assignee: The Procter & Gamble Company, Cincinnati, OH (US)

( * ) Notice: Subject to any disclaimer, the term of this patent is extended or adjusted under 35 U.S.C. 154(b) by 143 days.

(21) Appl. No.: 15/071,532

(22) Filed: Mar. 16, 2016

(65) Prior Publication Data

US 2016/0280489 A1 Sep. 29, 2016

(30) Foreign Application Priority Data

Mar. 26, 2015 (EP) ..... 15160953

(51) Int. Cl.
*B65H 18/08* (2006.01)
*B65H 18/04* (2006.01)
(Continued)

(52) U.S. Cl.
CPC ..... *B65H 18/08* (2013.01); *B65H 16/00* (2013.01); *B65H 18/04* (2013.01); *B65H 18/28* (2013.01); *B65H 2301/412845* (2013.01)

(58) Field of Classification Search
CPC ..... B65H 18/28; B65H 55/04; B65H 2301/4128; B65H 2301/41282;
(Continued)

(56) References Cited

U.S. PATENT DOCUMENTS 3,549,099 A * 12/1970 Hofbauer ..... B65H 23/1955 242/531.1
4,267,985 A * 5/1981 Rogers ..... B65H 35/02 225/103

(Continued)

FOREIGN PATENT DOCUMENTS

GB 2350375 11/2000
JP S63300058 12/1988

OTHER PUBLICATIONS

EP Search Report, EP Application No. EP15160953.
International Search Report and Written Opinion, PCT/2016/018841, dated May 23, 2016.

*Primary Examiner* — Leslie A Nicholson, III
(74) *Attorney, Agent, or Firm* — Christian M. Best

(57) ABSTRACT

The present invention relates to apparatus and methods for winding and unwinding web materials, the web materials having a plurality of narrow lanes which form a spool. In a first aspect of the invention each lane of web material is defined by a width measured in the axial direction of the spool and between a minimum and a maximum radial height measured radially from a central axis of the spool. Each lane is wound, in turn, with web material up to the maximum radial height, the web material is folded by a first, second, third and fourth folds so that the web material is realigned parallel to the adjacent lane and wound to form the adjacent lane.

5 Claims, 2 Drawing Sheets

(51) Int. Cl.
*B65H 18/28* (2006.01)
*B65H 16/00* (2006.01)

(58) Field of Classification Search
CPC ..... B65H 2301/41284; B65H 2301/412845; B65H 2701/37
USPC .... 270/8, 20.1, 41, 52.07, 52.08; 242/160.2, 242/531, 531.1
See application file for complete search history.

(56) References Cited

U.S. PATENT DOCUMENTS

| | | | | |
|---|---|---|---|---|
| 4,634,070 | A * | 1/1987 | Looper | B65H 18/10 242/413.3 |
| 6,007,016 | A * | 12/1999 | Helton | B65H 54/2812 242/160.2 |
| 6,138,934 | A | 10/2000 | Helton | |
| 6,209,814 | B1 | 4/2001 | Helton | |
| 6,533,213 | B2 * | 3/2003 | Durrance | B65H 16/02 242/560.1 |
| 8,157,197 | B2 * | 4/2012 | Jelinek | B05C 17/0207 242/178 |
| 2003/0122009 | A1 | 7/2003 | Abba et al. | |

* cited by examiner

APPARATUS AND METHOD FOR WINDING AND UNWINDING WEB MATERIAL

CROSS REFERENCE TO RELATED APPLICATION

This application claims the benefit, under 35 U.S.C. § 119, to EP Patent Application No. 15160953.4, filed on Mar. 26, 2015, which is hereby incorporated by reference in its entirety.

FIELD OF THE INVENTION

The present invention relates to apparatus and methods for winding and unwinding web materials. In particular the invention relates to winding and unwinding web materials having a plurality of narrow lanes.

BACKGROUND OF THE INVENTION

Narrow web materials can be level wound. By oscillating the narrow web material backwards and forwards across the roll during winding the level winding process provides a stable roll. However traversing the material in this way during winding subjects the web to a camber. Some materials are permanently deformed when subjected to a camber, and for these materials it is preferable to select a winding pattern with, principally, straight, in-line, winding.

An index wind, or step wind, is an arrangement of stacked lanes. The narrow web material is wound in-line for a predetermined number of layers, and then the web traverses over to the next lane position. The web is only subjected to camber during the period of winding when the web traverses from one lane to the next. The degree of camber is determined by the transverse width over which the web needs to be moved, the number of turns through which the traverse is spread, and the actual diameter. To keep the camber to a minimum, an S-shaped velocity profile of the traverse move may be employed.

It is desirable to provide an alternative winding system which would avoid subjecting the narrow web to a camber.

SUMMARY OF THE INVENTION

The present invention relates to apparatus and methods for winding and unwinding web materials, the web materials having a plurality of narrow lanes which form a spool. In a first aspect of the invention each lane of web material is defined by a width measured in the axial direction of the spool and between a minimum and a maximum radial height measured radially from a central axis of the spool. Each lane is wound, in turn, with web material up to the maximum radial height, the web material is folded by a first fold so that the web material passes in the axial direction across the lane at the maximum radial height, then folded by a second fold so that the web material passes in the radial direction, along the side of the lane, between the maximum radial height and the minimum radial height of the spool, then folded by a third fold so that the web material passes in the axial direction of the spool, then folded by a fourth fold so that the web material is realigned parallel to the adjacent lane and wound to form the adjacent lane.

In a second aspect of the invention the method of unwinding the spool comprises the steps of: unwinding a first lane of web material to a minimum radial height measured radially, Ra, from the central axis; releasing the web material between the third fold and the fourth fold; decelerating the rate at which the web material is unwound; and unwinding a lane of web material adjacent to the first lane.

The invention further relates to a apparatus for winding a web material, the web material having a plurality of narrow lanes which form a spool, wherein each lane of web material is defined by a width measured in an axial direction, Ax, of the spool, and between a minimum and a maximum radial height measured radially, Ra, from a central axis of the spool, and wherein each lane is wound, in turn, with web material up to the maximum radial height, the apparatus comprising:

- a source of web material;
- a folding finger to create a plurality of folds in the web material;
- a bonding device to temporarily bond the web material at the first fold;
- a traverse device to move the spool relative to the source of web material, displacing the web material in the axial direction, Ax, by a distance corresponding to one lane width.

DETAILED DESCRIPTION OF THE INVENTION

Aspects of the present disclosure relate to apparatus and methods for continuous delivering of a web material to downstream equipment during a manufacturing process, and more particularly relates to apparatuses and methods for unwinding multiple narrow lanes of web material rotatably mounted to a frame and delivering the web material to various downstream manufacturing processes. In the course of subsequent process steps the web material may be separated into individual or discrete web pieces and may form a part of a manufactured article. Such a structure is useful for disposable absorbent articles, such as, but not limited to, disposable baby diapers, training pants, adult incontinence article, feminine hygiene articles and the like. Such articles have varying requirements as to the desired absorbency depending on the intended use and/or user. In such embodiments, the web materials may be fluid permeable webs, such as non-woven material, or thermoplastic films, or thermoplastic-net materials, for example. Although the description below is mainly related to absorbent articles, it is to be appreciated that the apparatuses and methods described herein are also applicable to other types of manufactured goods. As used herein, "machine direction" (MD) is used to refer to the direction of the web material flow through a process.

"Narrow" as used herein in the context of narrow web material and narrow lanes preferably means between about 40 mm and about 110 mm, more preferably between about 60 mm and about 90 mm.

Figure 1:
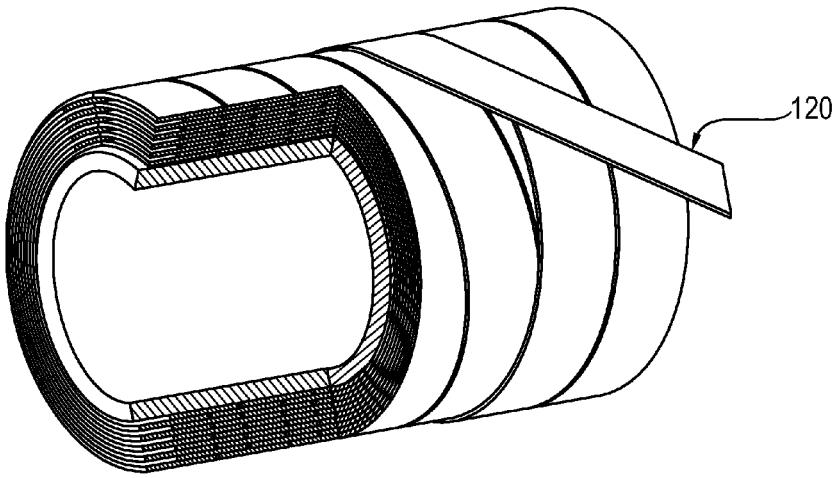
Figure 1 (Prior Art)
FIG. 1 shows a traverse winding pattern of the prior art.
Figure 2:
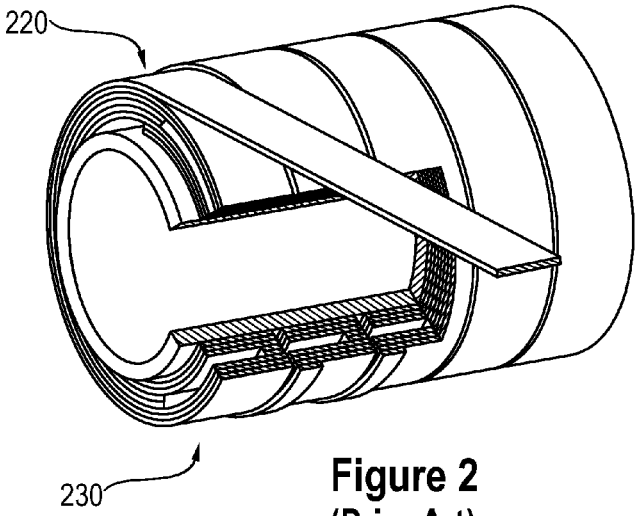
Figure 2 (Prior Art)
FIG. 2 shows an index winding pattern of the prior art.

FIGS. 1 and 2 illustrate prior art methods for winding a spool of narrow web material. FIG. 1 illustrates transverse winding, and FIG. 2 illustrates index winding, or step winding.

Figure 3:
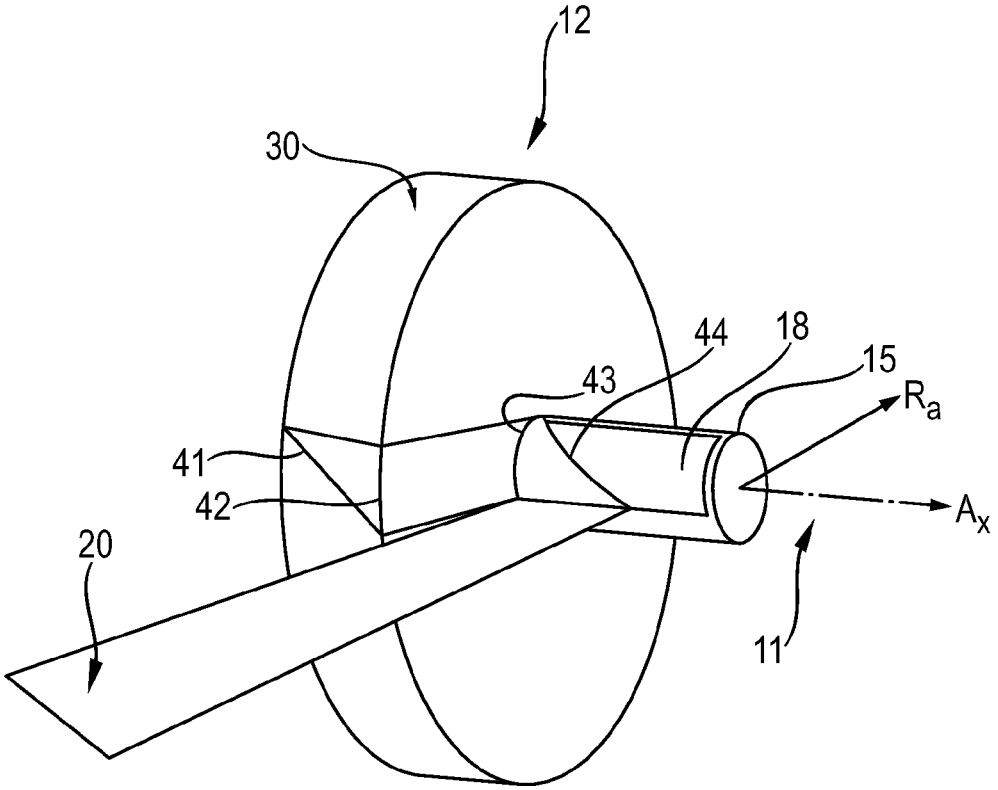
FIG. 3 shows a novel winding pattern of the present invention.

The present invention relates to apparatus and methods for winding and unwinding web materials, the web materials having a plurality of narrow lanes which form a spool, as shown in FIG. 3. Each lane 30 of web material 20 is defined by a width measured in the axial direction, Ax, of the spool 12 and between a minimum and a maximum radial height measured radially, Ra, from a central axis 11 of the spool. Each lane 30 is wound, in turn, with web material 20 up to the maximum radial height, the web material 20 is folded by a first fold 41 so that the web material 20 passes in the axial direction, Ax, across the lane 30 at the maximum radial height, then folded by a second fold 42 so that the web material 20 passes in the radial direction, Ra, along the side of the lane 30, between the maximum radial height and the minimum radial height of the spool 12, then folded by a third fold 43 so that the web material 20 passes in the axial direction, Ax, of the spool 12, then folded by a fourth fold 44 so that the web material 20 is realigned parallel to the adjacent lane and wound to form the adjacent lane.

The spool 12 may be wound onto a core 15. The core 15 may be a cardboard tube. The outer radius of the core 15 corresponds to the minimum radial height of the spool 12.

In one embodiment of the invention the web material 20 is secured to the core 15 between the third fold 43 and the fourth fold 44. This ensures that the web material remains correctly oriented during the winding process. The web material 20 may be secured to the core by means of adhesive. Preferably the adhesive is selected such that is secures the web material 20 to the core 15 when the adhesive is freshly applied, during the winding process, but the adhesive becomes less sticky with aging so that the adhesive does not inhibit the free release of the web material 20 from the core 15 during the unwinding process. For example, this can be achieved by selecting an adhesive that turns crystalline over time.

The web material 20 of one lane 30 is preferably spaced slightly apart from the web material of each adjacent lane. This reduces or avoids the risk of the web material 20 of one lane 30 becoming entangled with the web material 20 of the adjacent lane during unwinding. Preferably the gap between adjacent lanes should be minimal, but sufficient to accommodate any tracking variation. For example the gap between adjacent lanes may be up to about 10 mm, preferably from about 1 mm to about 5 mm.

Winding and Unwinding

In the following description a non-limiting example of a method of winding and unwinding a spool of the present invention is described.

Winding

The web material is transferred from a source, such as a parent roll onto a core, the core 15 being in the form of a cylindrical tube. Preferably the outer diameter of the core 15 is at least twice the width of the web material 20. The core 15 is prepared with a length of adhesive tape 18 fixed to the core 15, running axially along the outside of the core 15.

The web material 20 is attached to the core 15 at the position of the first lane, and the core 15 is rotated to draw the material web from the source, passing by a supply idler roll and a folding finger, until the first lane reaches the maximum radial height of the spool. The rotation of the core is stopped.

A method of temporary bonding, such as needle punching, engages at the tangential contact point of the web material 20 on the roll and tension is released. The folding finger rotates to form the first fold 41. Preferably the line of the first fold lies at an angle of about 45° to the axial direction, Ax. The web material 20 is clamped so that the first fold is held in place. The temporary bonding method should be selected such that shear load can be taken, but that the bond releases easily upon application of a peel force.

The finger runs towards the core 15 of the winder, forming the second fold 42 in the web material 20, at a path parallel to the connection line between the last idler and the winder shaft, until it reaches the core of the winder. The clamp is released.

The winder now traverses to the next lane position, and moves at the same time in running direction such that the travel in both directions is equal (generating a 45°). The finger continues to press against the core. The web material 20 now gets fixed to the adhesive tape 18 forming the third 43 and fourth 44 folds.

The winder rotates the core 15 building up tension and winding the web material 20 to form the next lane.

The sequence is repeated for each lane until the spool is complete.

Unwinding

The unwinding process needs to accommodate the change in tension when the spool switches from one lane 30 of web material 20 to the next.

Shortly before the traverse occurs from one lane 30 to the adjacent lane, the web material 20 is unwound from the minimum radial height and consequently the unwinder is running at a maximum rotational speed (RPM). The unwinder needs to be rapidly decelerated in order to avoid extreme overfeeding when the unwinding web material switches to the maximum radial height of the adjacent lane at the end of the traverse. For this, the rotational speed, RPM, needs to be controlled on a feed back or feed forward principle (following a certain predetermined speed profile). Given that the minimum radial height and maximum radial height are known, a buffer with a controlled take up of web material can be implemented. The profile can be calculated so that the buffer can be moved accurately. For example, dancer rolls may be used.

To improve the profile with which the buffer is moved, a tension measurement device may be placed downstream of the buffer, to verify the downstream tension profile. Based on the tension profile a new, improved position profile of the buffer can be calculated.

As this profile is dependent on the position of the lanes, this information needs to get determined. This can be done through software, or a bank of distance sensors can be implemented.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for a winding web material, the web material having a plurality of narrow lanes which form a spool, wherein each lane of web material is defined by a width measured in an axial direction of the spool, and between a minimum and a maximum radial height measured radially from a central axis of the spool, and wherein each lane is wound, in turn, with web material up to the maximum radial height, the method comprising the steps of:

folding the web material by a first fold so that the web material passes in the axial direction across the lane at the maximum radial height;

folding the web material by a second fold so that the web material passes in the radial direction, along the side of the lane, between the maximum radial height and the minimum radial height of the spool;

folding the web material by a third fold so that the web material passes in the axial direction of the spool;

folding the web material by a fourth fold so that the web material is realigned parallel to the adjacent lane and wound to form the adjacent lane;

unwinding a first lane of web material to a minimum radial height measured radially from the central axis;

releasing the web material between the third fold and the fourth fold;

decelerating the rate at which the web material is unwound; and unwinding a lane of web material adjacent to the first lane.

2. The method according to claim 1, wherein the plurality of narrow lanes are formed by winding the web material onto a cylindrical core.

3. The method according to claim 2, wherein the web material is releasably secured to the core at least between the third fold and the fourth fold.

4. The method according to claim 1, wherein the first fold lies at an angle of about 45° to the axial direction.

5. The method according to claim 1, comprising the step of buffering the take up of the web material, at least between the release of the third fold and release of the second fold.

* * * * *